US005899651A

United States Patent [19]

Jenvey

[11] Patent Number: 5,899,651

[45] Date of Patent: May 4, 1999

[54] COLUMN COUNTERBALANCING APPARATUS

[75] Inventor: Alan John Jenvey, Kirkby-in-Ashfield, United Kingdom

[73] Assignee: Abacus Holdings Limited, United Kingdom

[21] Appl. No.: 08/914,636

[22] Filed: Aug. 19, 1997

[51] Int. Cl.[6] ..... B66F 11/00

[52] U.S. Cl. ..... 414/23; 52/116

[58] Field of Search ..... 52/115, 116, 117, 52/118, 119; 414/23

[56] References Cited

U.S. PATENT DOCUMENTS

| | | | |
|---|---|---|---|
| 3,292,320 | 12/1966 | Laharty | 414/23 X |
| 3,355,847 | 12/1967 | Pratt | 52/116 |
| 3,362,116 | 1/1968 | Erickson et al. | 52/116 |
| 5,634,759 | 6/1997 | Jenvey | 414/23 |

FOREIGN PATENT DOCUMENTS

| | | | |
|---|---|---|---|
| 703615 | 2/1965 | Canada | 414/23 |
| 802177 | 2/1981 | U.S.S.R. | 414/23 |

*Primary Examiner*—Janice L. Krizek
*Attorney, Agent, or Firm*—Young & Basile, P.C.

[57] ABSTRACT

Counterbalancing apparatus for a lamp column in which an upper part of the latter is pivotally mounted on a fixed lower part so that the upper part can be swung down for lamp servicing, comprises a compression spring assembly or a hydraulic ram arranged to have a bearing engagement with the column parts and to be linked to the lower part in order to safely restrain lowering of the upper part or to counterbalance and assist or effect raising thereof. Alternatively a single or double acting ram or rams have a removable pivotal connection with respective column parts so as to act between them. For mobility and case of application the apparatus is wheel mounted.

3 Claims, 7 Drawing Sheets

COLUMN COUNTERBALANCING APPARATUS

This invention relates to apparatus for use in counterbalancing a column (such as is used for supporting lighting apparatus) where the column consists of an upper column part pivotally mounted about a horizontal axis on a lower fixed column part whereby the upper part can be swung down for convenient servicing of an appliance at the normally upper end of the column.

Since the upper column part can be of considerable weight it is necessary to provide adequate support for it during such lowering and raising of the upper column part so that the operation is facilitated and possible damage or injury avoided or minimised.

The object of the invention is to provide effective counterbalancing apparatus whereby general use and operative engagement or connection of the apparatus with a column can be readily carried out. Practical advantages in this and other respects will be apparent from the following description.

Basically according to the invention column counterbalancing apparatus comprises spring means or fluid pressure operated means such as a single or double acting ram or rams which can be engaged with, or connected to, respective upper and lower parts of a column so as to act between them in counterbalancing lowering of the column upper part or raising thereof.

Figure 14:
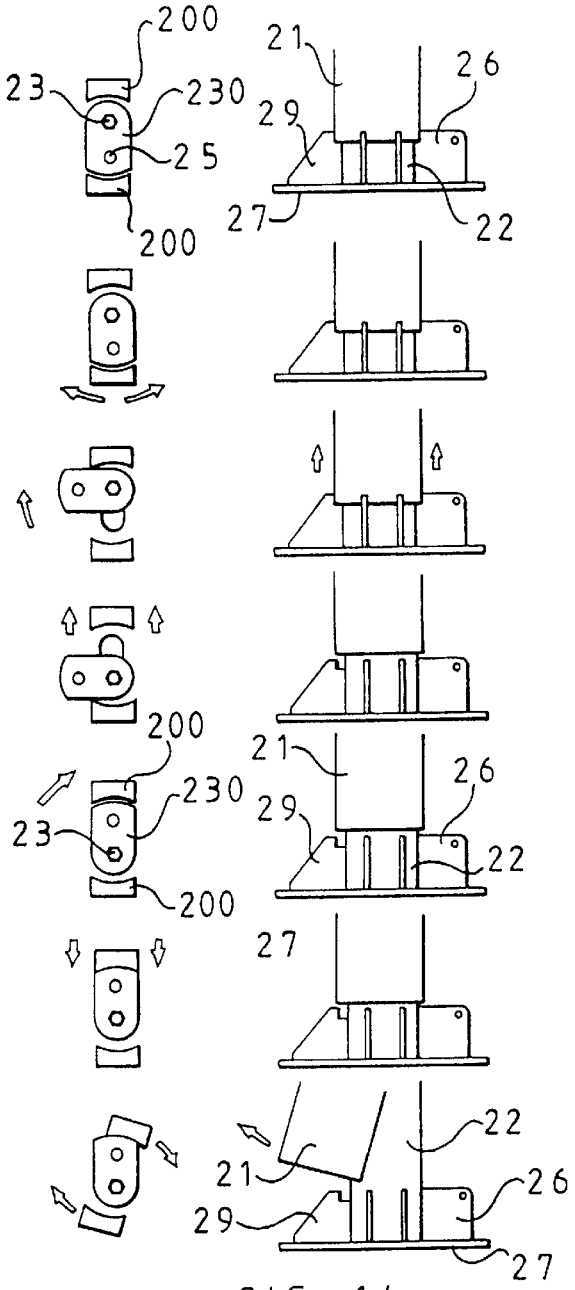
Figure 15:
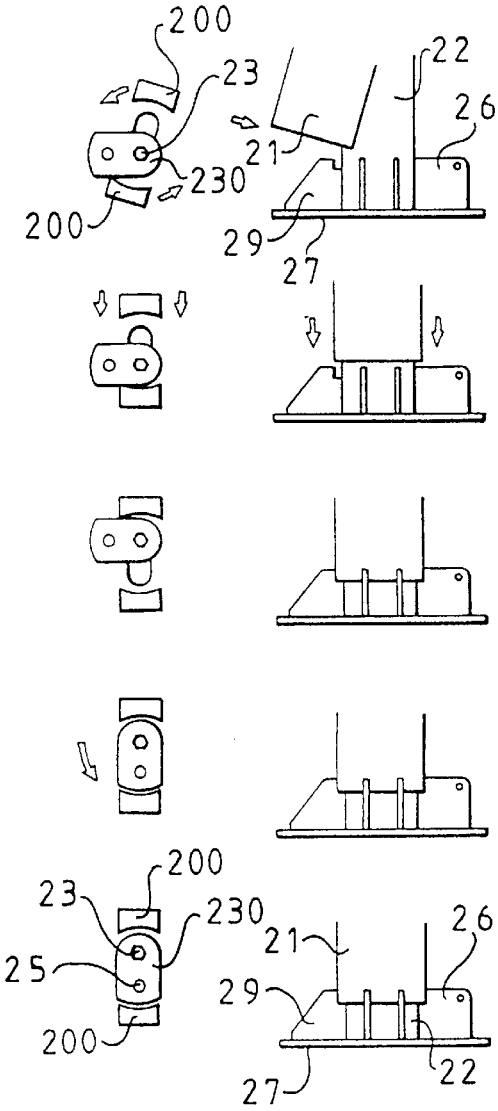

Practical examples of the apparatus according to the invention will now be described with reference to the accompanying drawings which are mainly perspective views and in which:

FIGS. 1 to 4 show a spring loaded form of the apparatus and its operation;

FIGS. 5 to 7, 8 to 10 and 11 to 13 respectively show different arrangements of single acting hydraulic ram operated forms of the apparatus;

FIGS. 14 and 15 diagrammatically show locking plate operation and corresponding column movement; and FIGS. 16 to 19 and 20 to 22 respectively show double acting hydraulic ram operated forms of the apparatus.

Like parts are referred to throughout the drawings by the same or similar reference numerals.

Referring to FIGS. 1 to 4 the spring loaded form of the counterbalancing apparatus 1 is applied to a two part lamp column 2 of which a downward extension 21 of the upper part 20 is pivotally mounted about a horizontal axis at 23 on the upstanding fixed lower part 22. In normal use an inverted cup portion or lid 24 at the lower end of the upper column part 20 engages over the upper end of the lower part 22 for locating the upper part 20 in the upright position. The upper part 20 is retained in this position by a locking screw 25.

The counterbalancing apparatus 1 comprises a substantial compression spring 10 slidable about a support or shaft 11 and acts between upper and lower collars 12, 13 on the shaft 11. A pair of arms 14 are downwardly inclined from the upper collar 12 and are pivotally connected at 15 to respective upwardly directed arms 16 from the base 110 of the shaft 11. The upper collar 12 also carries a pivoted curved bearing member or pad 17 whilst the shaft base 110 is provided with a pair of wheels 18 and the upper end with a lifting handle 111.

After the apparatus 1 has been wheeled against the column 2 it is raised (FIG. 3) so that a pin 3 carried by an operating lever 30 can be inserted through hollow pivot bushes at 15 of the arm linkage 14, 16 and through pivot bushes at 23 of the downward extension 21 to the column lower part 22. The purpose of the pin 3 is to operate cam mechanism of known form within the column lower part 22 whereby the upper part 20 is raised sufficiently for the cup or lid 24 to move clear of location from the lower part 22, i.e. after removal of the locking screw 25. The lever 30 is moved through 180° for required operation of the pin 3.

The column upper part 20 can then be swung down (FIG. 4) with the downward extension 21 seating against the curved bearing pad 17. Compression of the spring 10 thus counterbalances the lowering of the upper part 20 in a safe manner. The normally upper or lamp end of the column upper part 20 may rest on a trestle when fully lowered. As will be appreciated the spring loaded apparatus 1 provides counterbalancing and assistance during raising of the column upper part 20.

Figure 1:
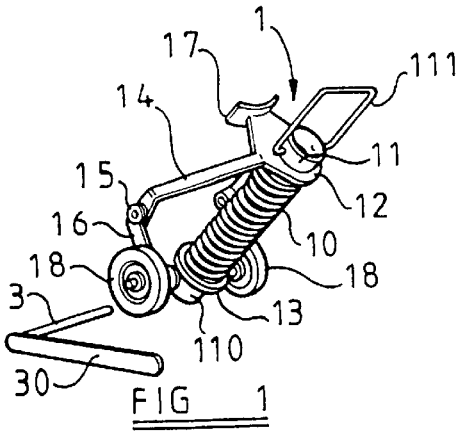
Figure 2:
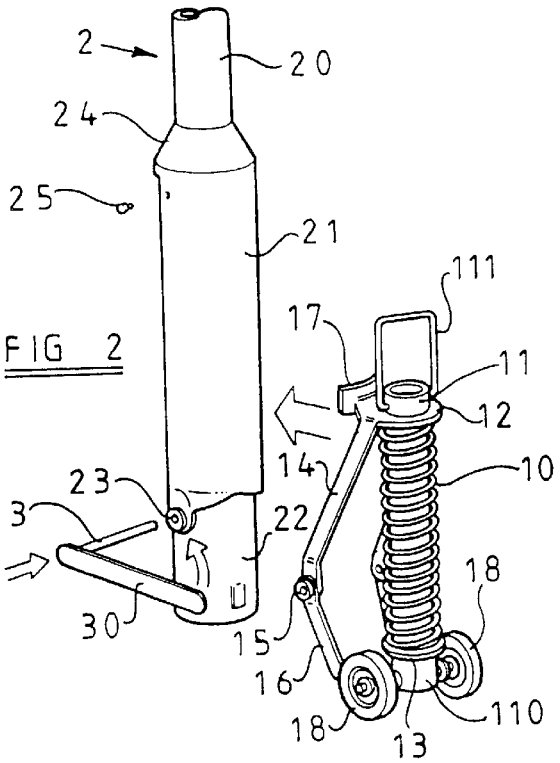
Figure 3:
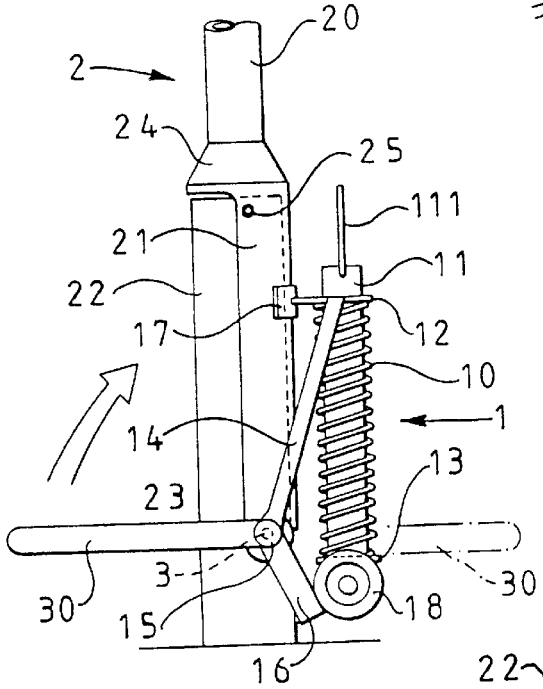
Figure 4:
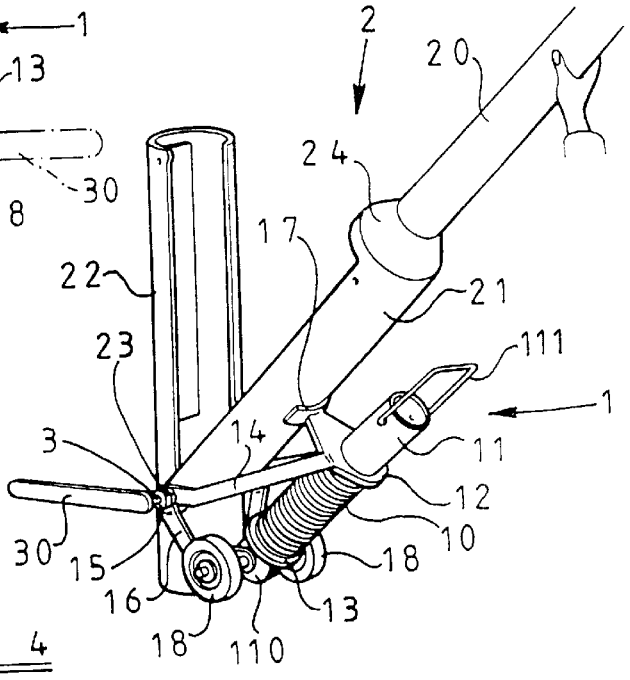
Figure 5:
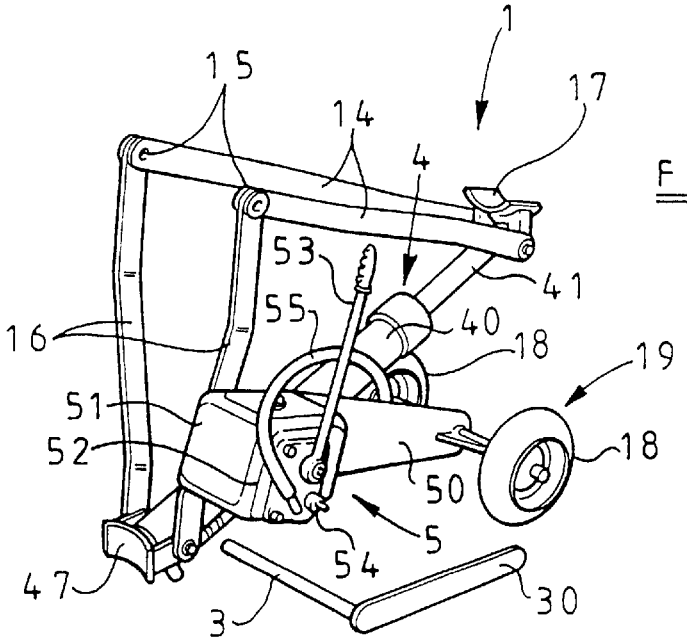
Figure 6:
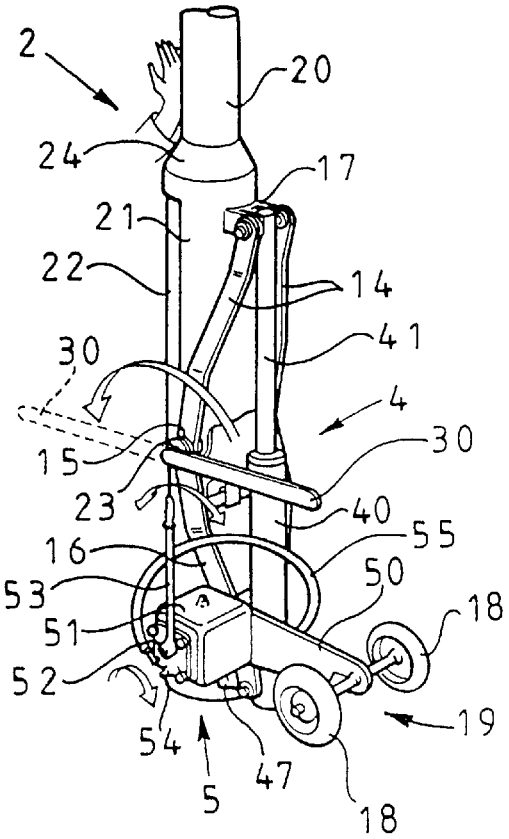
Figure 7:
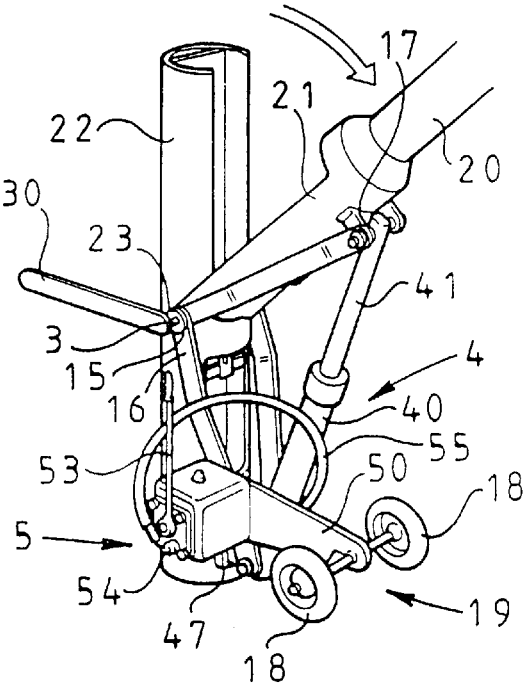

A hydraulically loaded form of the apparatus 1 is shown in FIGS. 5 to 7 in which a single acting hydraulic ram 4 together with a hydraulic power unit or pack 5 are mounted on a beam 50 having a pair of wheels 18 which latter thus acts as a trolley 19. The upper end of the ram rod 41 carries a pivoted curved bearing pad 17 and is interlinked in the manner already described by pivotally connected pairs of arms 14, 16 with the base of the ram cylinder 40 where a further pivotally mounted curved bearing pad 47 is provided. The hydraulic power pack 5 comprises an oil reservoir tank 51, a pump 52 operated by a lever 53 and a control valve 54, the pump 52 being connected by a hose 55 to the lower end of the ram cylinder 40.

The apparatus 1 is wheeled against the column 2 and raised so that the pivot bushes at 15 of the arm linkage 14, 16 are aligned with those at 23 of the downward extension 21 for insertion therethrough of the lever operated pin 3 again in the manner already described. In this position the upper pivoted bearing pad 17 bears against the downward extension 21 and the lower pivoted bearing pad 47 bears against the base portion of the lower column part 22.

Firstly the ram rod 41 is extended by operation of the pump lever 53 and the control valve 54 is closed. After release of the column upper part 20 from the lower part 22 by removal of the locking screw 25 and also by operation of the internal cam mechanism by the lever 30 and pin 3, the upper column part 20 can then be gently lowered against the counterbalancing compression action of the ram 4 (FIG. 7). During such lowering the control valve 54 is opened slightly for restrained lowering of the column upper part 20 and is then closed after the upper part 20 has been fully lowered to the substantially horizontal position.

To raise the column upper part 20 the pump lever 53 is operated to extend the ram 4 and, after location and locking of the upper part 20 on the lower part 22, the apparatus is then removed with retraction of the ram 4 as in FIG. 5.

To raise a lowered column upper part 20, e.g. during installation of a column 2, the trolley mounted ram 4 in the retracted condition can be positioned and engaged by the pads 17, 47 under the upper part 20 and with the lower part 22 respectively. The pump lever 53 is then operated to effect counterbalanced raising of the upper part 20.

Figure 8:
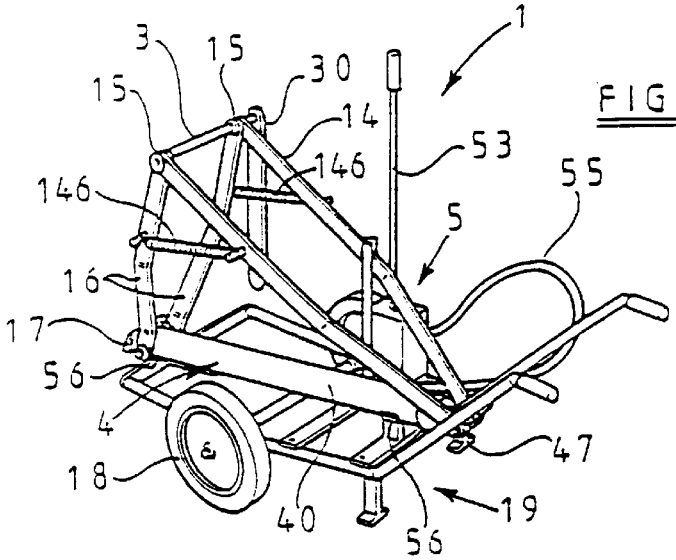
Figure 9:
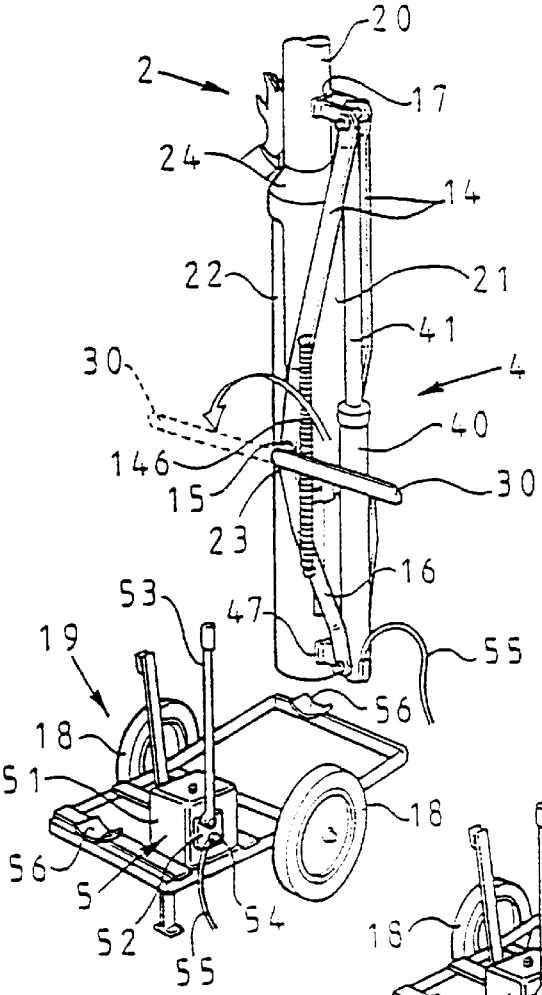
Figure 10:
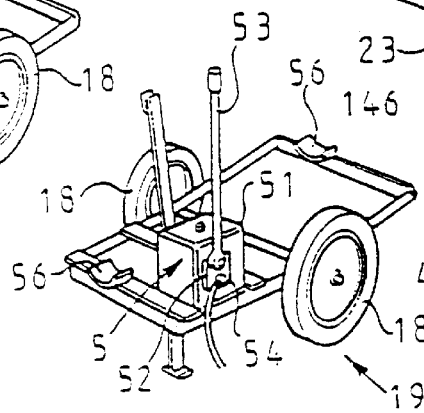
Figure 10:
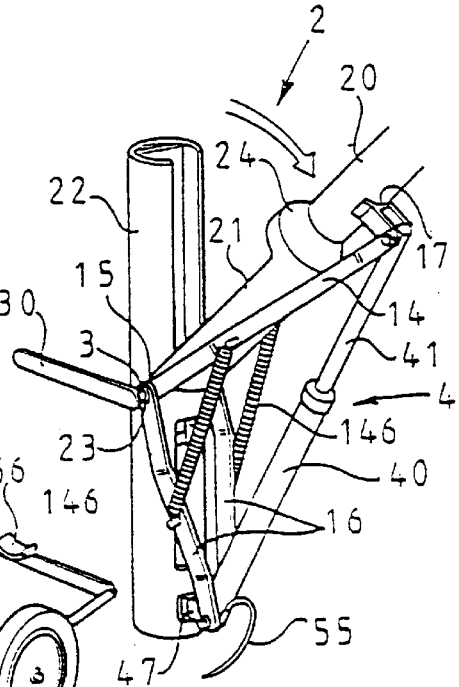

Referring to FIGS. 8 to 10, the single acting ram 4 is carried by rests 56 on a wheeled trolley 19 which fixedly carries the power pack 5. In use the ram 4 is removed from the trolley 19 and applied to the column 2 by the upper and lower bearing pads 17, 47 and operated in the same way as described above, the hose 55 from the power pack 5 to the ram 4 being of sufficient length for the purpose. The interlinked pairs of arms 14, 16 pivotally connected to the ram 4 are shown connected by tension springs 146 to facilitate retraction of the ram 40 especially for stowage on the trolley 19.

Figure 11:
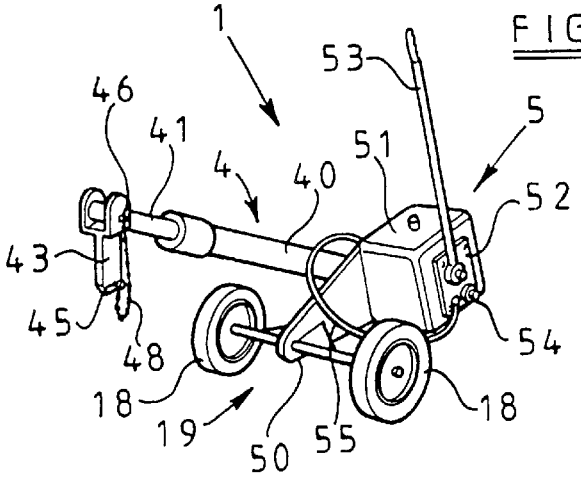
Figure 12:
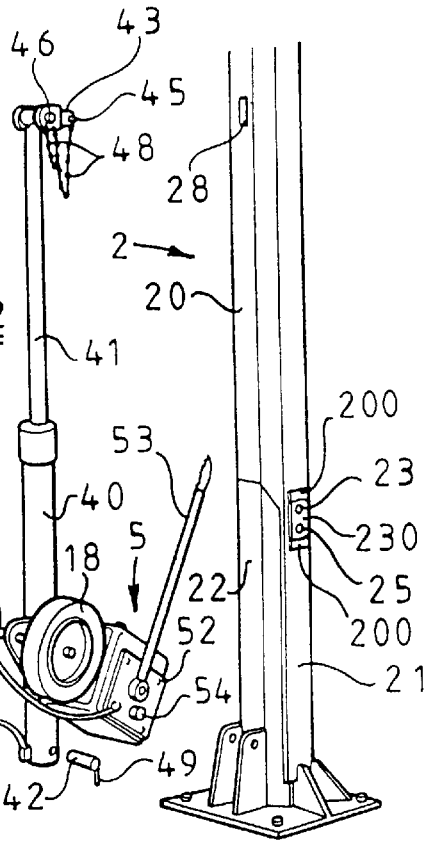
Figure 13:
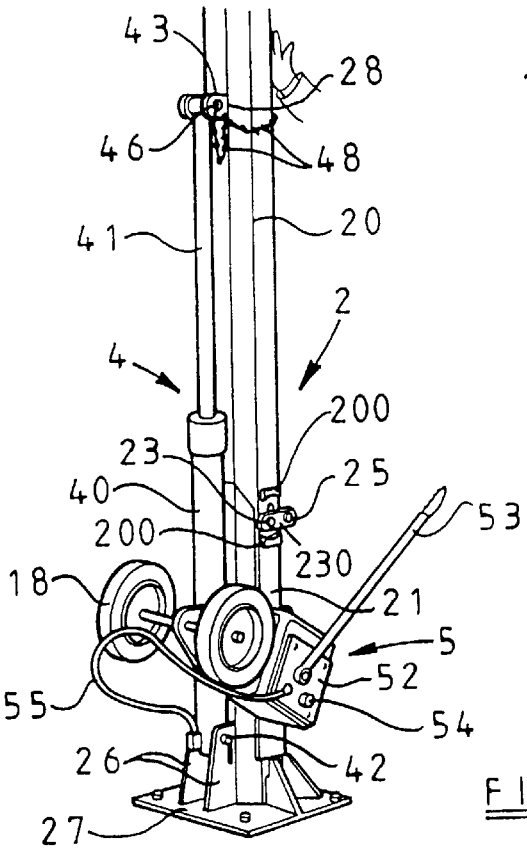

In FIGS. 11 to 13 a single acting ram 4 is carried by a trolley 19 together with the power pack 5 in a similar manner to the arrangement of FIGS. 5, 6 and 7. However the base of the cylinder 40 is secured by a pivot pin 42 between gusset plates 26 of a base plate 27 for bolt mounting to the lower part 22 of the column 2 in position of use. The upper end of the ram rod 41 is provided with a pivoted jacking lug 43 which enters a slot 28 in the column upper part 20 after suitable extension of the ram rod 41. The lug 43 is held in engagement with the slot 28 by a retaining pin 45 inserted through the free end of lug 43 where it protrudes through the other side of the upper part 20 (not visible in FIG. 13).

After withdrawing the locking screw 25 from the upper part 20, further extension of the ram 4 lifts the lower end of the downward extension 21 out of engagement with gusset plates 29 (FIG. 14) opposite to the plates 26 to enable the upper part 20 to be swung down and against the counterbalancing ram 4 about the pivot 23. A locking plate 230 at the pivot 23 can be rotated to retain the column upper part 20 in the raised position so that the downward extension 21 remains clear of the gusset plates 29 prior to and during initial lowering of the upper part 20 (see FIG. 14). It should be noted that the locking screw 25 is screwed into or from the column upper part 20 through the locking plate 230.

The action of the locking plate 230 between co-operating abutments 200 on the column upper part 20 is shown diagrammatically in FIG. 14 and also in relation to corresponding positioning of the downward extension 21 of the upper part 20 relative to the gusset plates 29 i.e. up to the commencement of lowering of the upper part 20. Likewise operation of the locking plate 230 in relation to location of the downward extension 21 following final raising of the upper part 20 is shown in FIG. 15.

The retaining pin 45 and also a pivot pin 46 for the lug 43 on the piston rod 41 are captive to the lug 43 by chain or the like 48 to avoid loss during use. Likewise the pivot pin 42 at the base of the cylinder may be similarly held captive as indicated at 49 in FIG. 12.

Figure 16:
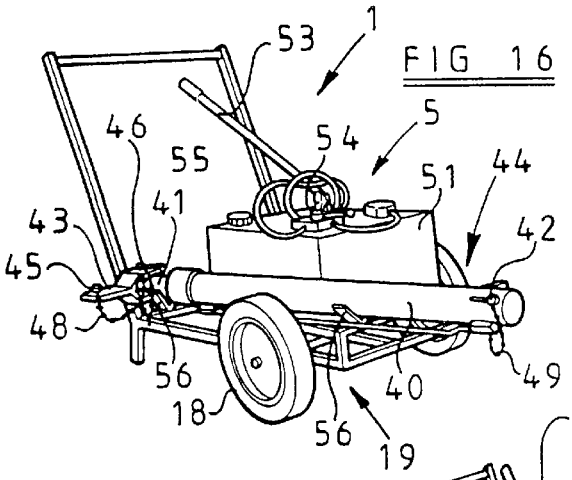
Figure 17:
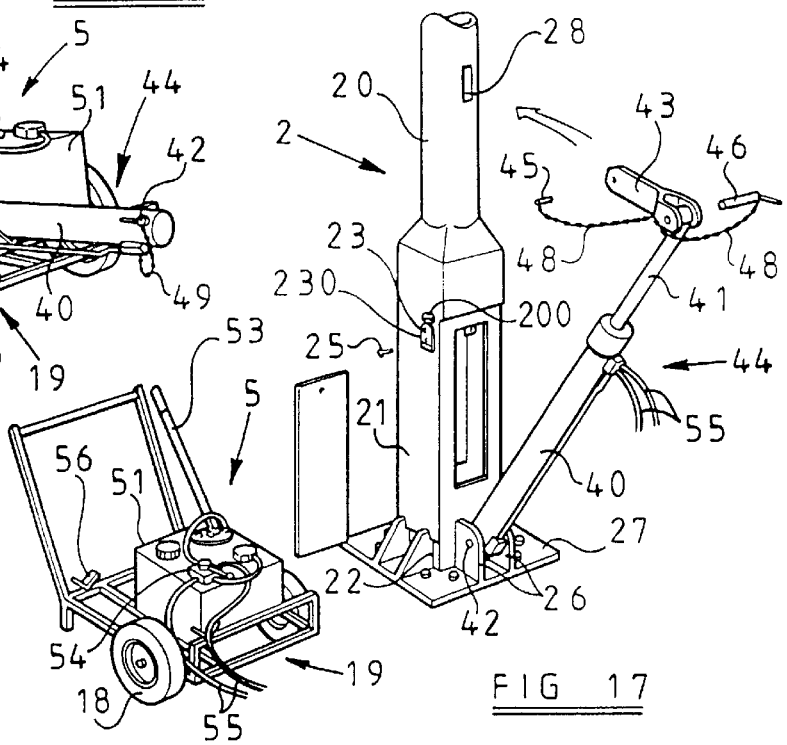
Figure 18:
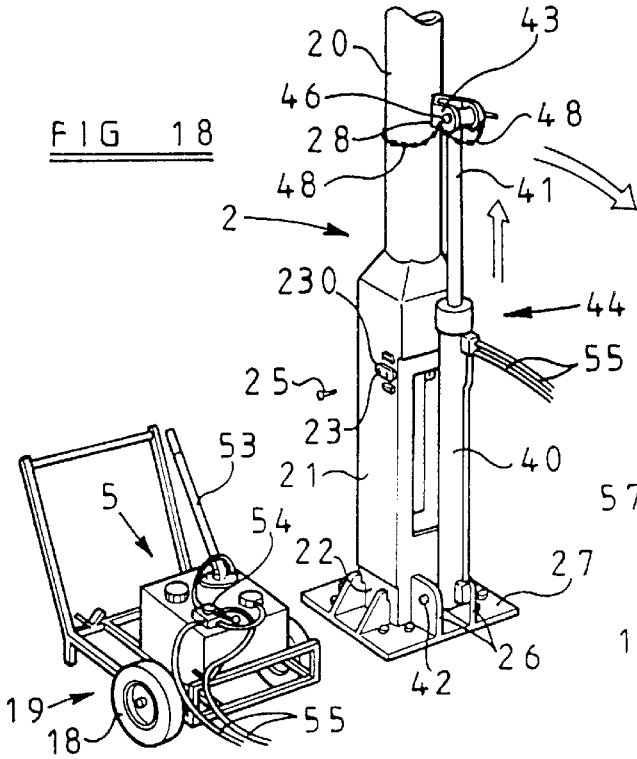

The arrangement of FIGS. 16 to 18 is similar to that of FIGS. 11 to 13 except that a double acting ram 44 is employed and is carried on rests 56 of the power pack trolley 19 for wheeling to a column. Thus the base of the ram cylinder 40 is pivotally connected to gusset plates 26 on the mounting base plate 27 whilst the jacking lug 43 is received in the slot 28 of the column upper part 20.

Figure 19:
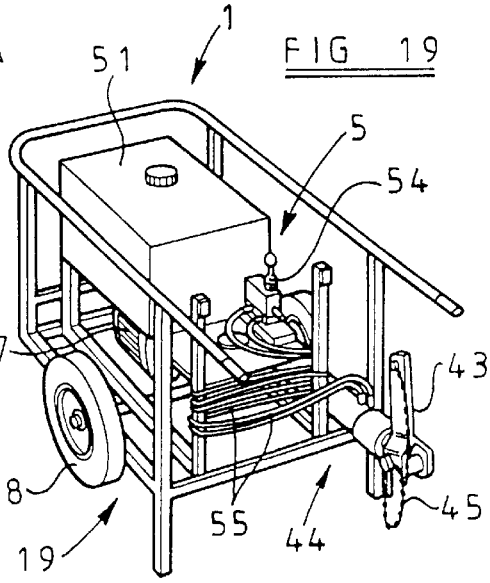

In FIG. 19 the double acting ram 44 is carried at one side of a modified power pack trolley 19 for wheeling into position of use. In this form of the apparatus the pump of the power pack 5 is driven by an electric motor 57.

Figure 20:
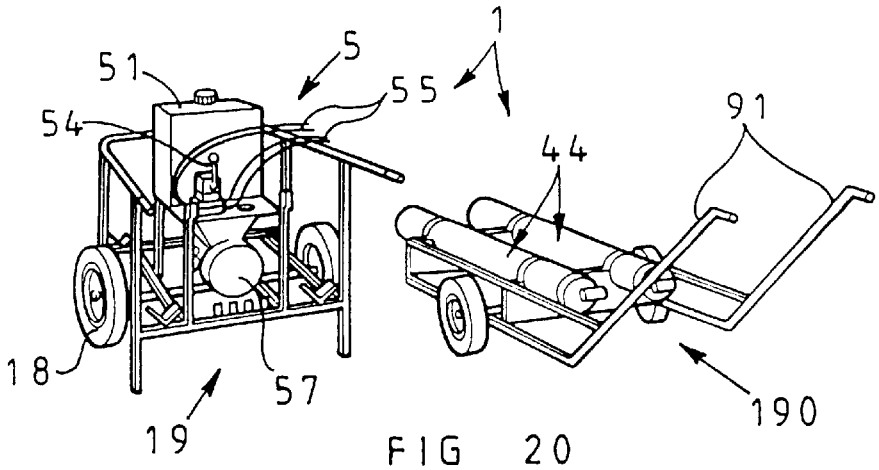
Figure 21:
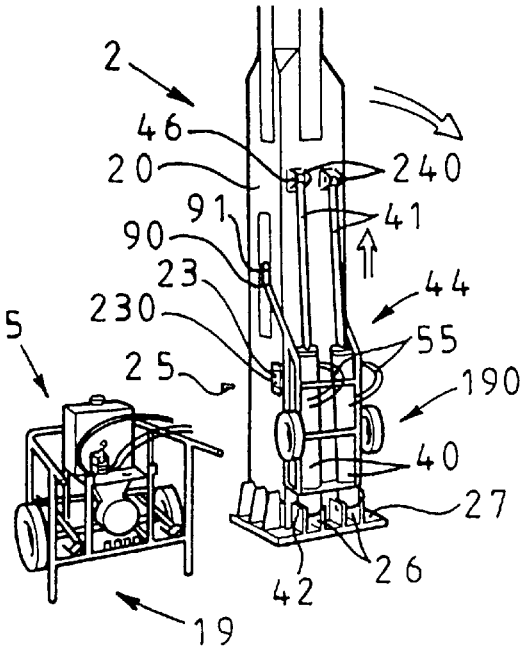
Figure 22:
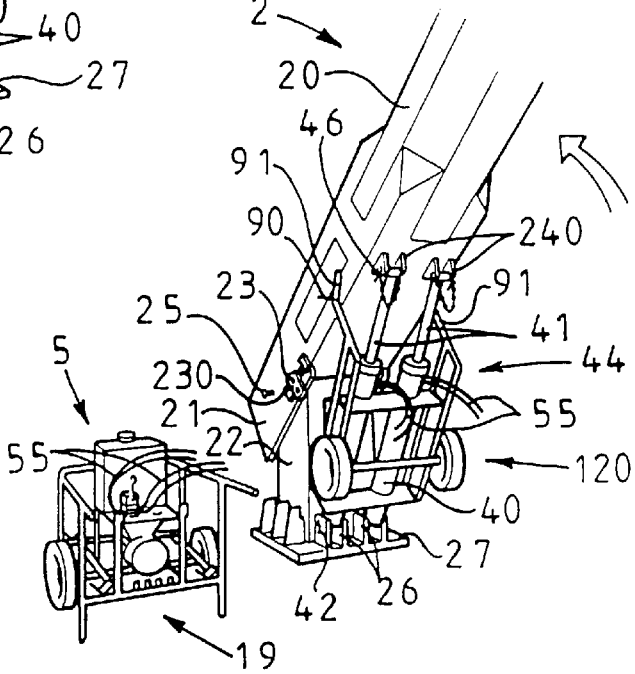

For heavy duty use and as shown in FIGS. 20 to 22 a pair of parallel double acting rams 44 are mounted on their own trolley 190 for wheeling to a column 2, the trolley 190 remaining attached to the rams 44. Each extended piston rod 41 is pivotally connected by removable pins 46 to corresponding lugs 240 on the column upper part 20 which latter is pivotally mounted at 23 on the lower part 22. The base of each ram cylinder 40 is removably pivotally connected by pins 42 to respective gusset plates 26 on the mounting base plate 27.

After connection of the rams 44 in the above manner to the column 2 and release operation of the locking screw 25, the ram piston rods 41 are further extended to lift the lower end of the downward extension 21 out of engagement with gusset plates 29 (FIGS. 14 and 15) at the opposite side of the column lower part 22 to the pivot gusset plates 26. At the same time the locking plate 230 is rotated to retain the column upper part 20 and its downward extension 21 in the raised position. The column upper part 20 can then be swung down against the counterbalancing action of the rams 44 (FIG. 22). A chain 90 is shown provided to loosely retain the trolley 190 by its handles 91 relative to the column upper part 20.

The rams 44 are supplied with hydraulic oil and controlled from a power pack 5 on a separate trolley 19. The pump 52 is shown driven by an electric motor 57 and the control valve 54 is preferably such that immediately it is released the pump 52 stops thus safely stopping angular movement of the column upper part 20 at the position which it has reached.

In all of the hydraulic forms of the apparatus a restrictor valve is incorporated in the hydraulic system to restrain lowering of the column upper part 20 in the event of failure of the ram 4, 44 and/or hose 55.

I claim:

1. A counterbalancing apparatus for a column of the type comprising a fixed lower column part and upper column part, and pivot means operative to permit said upper column part to be pivotally raised and lowered relative to said lower column part, said counterbalancing apparatus comprising:

a base part which is adapted to bear against said lower column part;

an upper bearing member which is adapted to engage said upper column part;

compression means operative to act between said base part and said upper bearing member;

a linkage adapted for pivotally connecting said compression means to said lower column part; and at least one ground-engaging wheel, whereby said apparatus can be wheeled into and out of proximity to said column, and whereby raising and lowering of said upper column part is counter balanced by, respectively, expansion and contraction of said compression means.

2. A counterbalancing apparatus for a column of the type comprising a fixed lower column part, and upper column part, and pivot means operative to permit said upper column part to be pivotally raised and lowered relative to said lower column part, said counterbalancing apparatus comprising:

a base part which is adapted to bear against said lower column part;

an upper bearing member which is adapted to engage said upper column part;

compression means operative to act between said base part and said upper bearing member, wherein said compression means comprises at least one piston and cylinder device;

a linkage adapted for pivotally connecting said compression means to said lower column part; and a power unit operative to supply hydraulic fluid under pressure to said at least one piston and cylinder device, said power unit being carried by a wheeled trolley, whereby raising and lowering of said upper column part is counterbalanced by, respectively, expansion and contraction of said compression means.

3. A counterbalancing apparatus for a column of the type comprising a fixed lower column part, and upper column part, and pivot means operative to permit said upper column part to be pivotally raised and lowered relative to said lower column part, said counterbalancing apparatus comprising:

a base part which is adapted to bear against said lower column part;

an upper bearing member which is adapted to engage said upper column part;

compression means operative to act between said base part and said upper bearing member, wherein said compression means comprises at least one piston and cylinder device, and said at least one piston and cylinder device comprises a pair of parallel rams; and a linkage adapted for pivotally connecting said compression means to said lower column part, whereby raising and lowering of said upper column part is counterbalanced by, respectively, expansion and contraction of said compression means.

* * * * *